US005181463A

United States Patent [19]

Lackner

[11] Patent Number: 5,181,463

[45] Date of Patent: Jan. 26, 1993

[54] INTEGRATED PRECOMPACTING TRASH COMPACTOR

[75] Inventor: Raymond F. Lackner, Pittsburgh, Pa.

[73] Assignee: M. Glosser & Sons, Inc., Johnstown, Pa.

[21] Appl. No.: 757,952

[22] Filed: Sep. 12, 1991

[51] Int. Cl.[5] ..... B30B 7/00

[52] U.S. Cl. ..... 100/137; 100/188 R; 100/193; 100/208; 100/215; 100/218; 100/229 A; 100/237; 100/295

[58] Field of Search ..... 100/137-143, 100/179, 188 R, 189, 190, 193, 208, 215, 218, 229 A, 237, 269 R, 295

[56] References Cited

U.S. PATENT DOCUMENTS

| | | | |
|---|---|---|---|
| 2,695,110 | 11/1954 | Feidert | 100/188 R X |
| 3,355,044 | 11/1967 | Nelson | 100/215 X |
| 3,454,174 | 7/1969 | Nelson | 100/272 X |
| 3,638,561 | 2/1972 | Price et al. | 100/215 |
| 3,893,386 | 7/1975 | Wise | 100/229 A X |
| 3,908,538 | 9/1975 | Boyd | 100/215 X |
| 4,016,988 | 4/1977 | Dahlin | 414/525.3 |
| 4,113,125 | 9/1978 | Schiller | 100/295 X |
| 4,213,384 | 7/1980 | Telling | 100/215 X |
| 4,358,994 | 11/1982 | Talley | 100/137 X |
| 4,374,491 | 2/1983 | Stortroen et al. | 100/229 A X |
| 4,757,758 | 7/1988 | Tondo | 100/215 X |

FOREIGN PATENT DOCUMENTS

| | | | |
|---|---|---|---|
| 0054750 | 6/1982 | European Pat. Off. | 100/237 |
| 60-61199 | 4/1985 | Japan | 100/229 A |

*Primary Examiner*—Philip R. Coe
*Assistant Examiner*—Stephen F. Gerrity
*Attorney, Agent, or Firm*—Buchanan Ingersoll; George Raynovich, Jr.

[57] ABSTRACT

A trash compactor is provided that has a single ram that simultaneously precompacts trash in an auxiliary precompacting chamber and compacts trash that has already been precompacted in a main compacted and storage chamber. The ram has a single actuating device and efficiently provides for both precompacting in the auxiliary precompacting chamber and for compacting in the compacting and storage chamber with each stroke of the ram.

15 Claims, 7 Drawing Sheets

INTEGRATED PRECOMPACTING TRASH COMPACTOR

BACKGROUND OF THE INVENTION

1. Field of the Invention

This invention relates to trash compactors and more particularly to trash compactors having a two stage compacting process with a single ram for compacting in both stages.

2. Description of the Prior Art

Collecting and transporting trash from urban communities has become a major industry throughout the civilized world. Because trash must be transported from urban areas to areas where it can be left in landfills or otherwise disposed of, an important function in transporting trash is to first compact it so as to reduce the volume required to transport a given weight of waste material.

Trash compactors have been utilized in homes and apartment buildings to compact trash. They have also been utilized on trucks which collect trash in urban areas to increase the payload of the trucks as the trucks collect the material from households and commercial establishments. Trash compactors have also been utilized in trash transfer stations where trash is brought by vehicles that collect it in urban areas and reprocessed and placed on larger vehicles for long haul transhipment to remote landfills or other disposal locations.

The trash compactor of the present invention contemplates an efficient two stage compacting device in which a single ram compresses and compacts trash material in both stages of compaction.

Trash compactors on refuse trucks are well known. U.S. Pat. Nos. 3,355,044, 3,454,174, 4,016,988, and 4,113,125 are all examples of trash compactors mounted on refuse trucks.

Trash compactors for use in homes and apartment buildings are also well known. Examples of these compactors are shown in U.S. Pat. Nos. 3,638,561 and 4,757,758. Multistage trash compactors are also known as is evidenced by U.S. Pat. No. 3,908,538.

The multistage compactor of the present invention is particularly well suited for compacting bottles and cans, particularly plastic bottles which, when they have a cap on them, are difficult to crush or break, and the two stage process of the present invention permits bottles and cans to be precompacted before they are compacted a second time. U.S. Pat. No. 4,213,384 recognizes the difficulty of compacting bottles and cans and attempts to solve this problem with a mechanism quite different than that of the present invention.

The multistage compactor of the present invention is also useful in precompacting bulky items, such as cardboard cartons, before they are moved into the storage area of the present invention for a second stage of compaction.

SUMMARY OF THE INVENTION

In accordance with the present invention, there is provided a trash compactor having a main compacting and storage chamber and an auxiliary precompacting chamber that selectively communicates with the main compacting and storage chamber. A ram is provided that has a first portion that compacts material within the main compacting and storage chamber, a second portion that compacts material within the auxiliary precompacting chamber, and a third portion that substantially blocks entry from the auxiliary precompacting chamber to the main compacting and storage chamber while the ram is compacting material in the auxiliary precompacting chamber. Means are provided to reciprocate the ram relative to the main and auxiliary chambers to compact material within the chambers and also to permit ingress of precompacted material from the auxiliary precompacting chamber to the main compacting and storage chamber after material is precompacted in the auxiliary precompacting chamber.

Accordingly, a principal object of the present invention is to provide an efficient two stage trash compactor having a single ram for compacting in both stages.

Another object of the present invention to be provide a trash compactor which is well suited to crushing and breaking bottles and cans that are segregated from other trash under environmental requirements and placed for collection.

Another object of the present invention is to provide trash compactors of the two stage type which may be utilized on a refuse vehicle, at fixed locations or in a transfer station.

An additional object of the present invention is to provide trash compactors that have safety features to prevent injury of those working with them.

These and other objects of the present invention will become apparent as this description proceeds in conjunction with the accompanying drawings and the appended claims.

DESCRIPTION OF THE PREFERRED EMBODIMENTS

Figure 1:
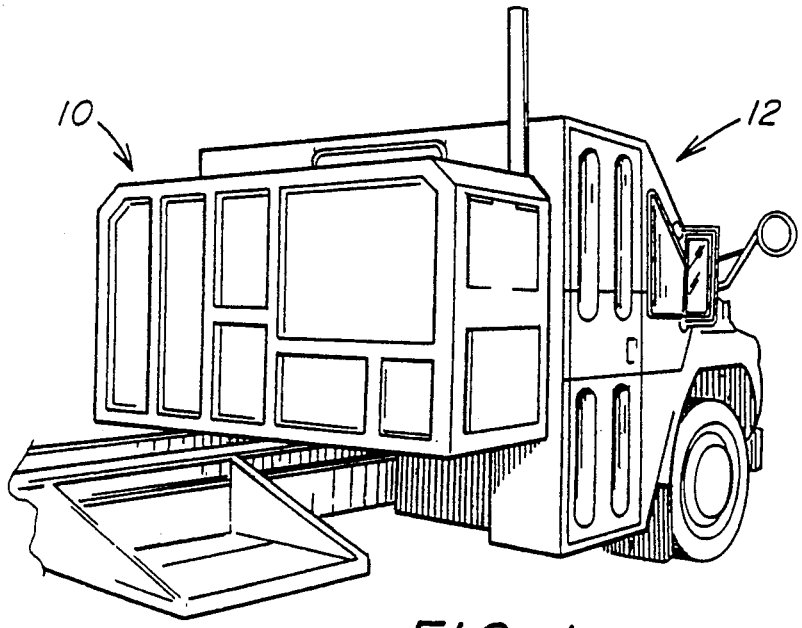
FIG. 1 is a perspective view of a truck with one embodiment of the trash compactor of the present invention mounted thereon.

Referring to the drawings, and particularly to FIGS. 1 through 5, there is shown a trash compactor indicated generally at 10. In FIG. 1 the trash compactor is shown mounted on a truck 12. The configuration of the compactor 10 shown in FIGS. 1-5 is particularly adapted for the compacting of bottles, plastic bottles and cans which have been segregated by a homemaker in accordance with environmental requirements that are prevalent in many communities. These bottles and cans are segregated from the general trash and garbage within the urban communities although they may all be transported in the same truck. As shown in FIG. 1, the trash compactor 10 is mounted adjacent to the cab of the truck and receives the bottles and cans. Rearwardly on the truck tee general trash and garbage is placed within the truck body (not shown).

The trash compactor 10 has a body 14 with a main compacting and storage chamber 15 comprising a lower portion of the body 14. A ram 16 is positioned for reciprocating motion within the compactor body 14. The lower portion of the body 14 has doors 18 for emptying the compacted material when the truck arrives at its destination.

The ram 16 is reciprocated by a hydraulic cylinder 20 fixed to the compactor body 14 and a piston 22 fixed to the ram 16. The cylinder 20 and piston 22 are of conventional design and arrangement and are double acting. Conventional controls (not shown) actuate the cylinder 20 and piston 22 at the command of the operator. The ram 16 has a first portion 24 that extends into the main compacting and storage chamber 15. The ram 16 has second portions 26 that extend outwardly from the main body of ram 16 and into auxiliary precompacting chambers 27 of the compactor body 14. The ram 16 has third portions 28 which substantially block the passage from auxiliary precompacting chambers 27 to the main compacting and storage chamber 15 when the ram is positioned as shown in FIG. 1.

Each auxiliary precompacting chamber 27 has a liner 30 that has a bottom wall 32 and upwardly extending sidewalls 33. Each liner 30 is pivoted on a horizontal pivot pin 34. Each liner 30 has a horizontally extending actuating bar 36 which is contacted by ram second portions 26 to pivot the liners 30 about pivot pin 34 as will be described.

Each auxiliary precompacting chamber 27 has a door 38 which is hinged horizontally at its top on hinge 40. A door actuating arm 42 is pivotally connected to the door 38 below hinge 40 and is contacted by ram second portion 26 to open and close the doors 38. A flexible web 44 is connected to the bottom wall 32 of each liner 30 and is also connected to the bottom wall 46 of each auxiliary precompacting chamber 27 in order to prevent material from entering between the bottom walls 32 of the liners 30 and the bottom walls 46 of auxiliary precompacting chambers 27 when liners 30 are pivoted upwardly away from the respective bottom walls 46 of auxiliary compacting chambers 27.

Figure 2:
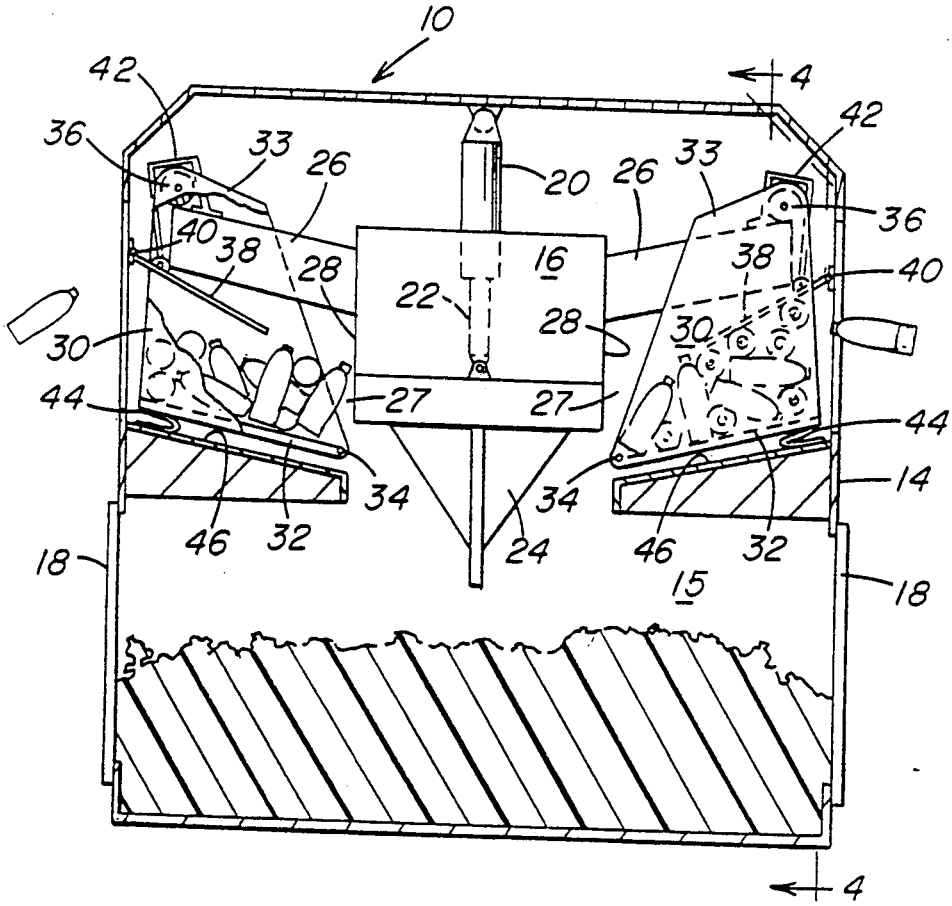
FIG. 2 is an elevation in partial section of the compactor of FIG. 1.

In the operation of the trash compactor 10 shown in FIGS. 1-5, the neutral position of ram 16 is shown in FIG. 2 with the liners 30 within auxiliary precompacting chambers 27 in a lowered position and the ram second portions 26 raised above the bottom walls of liners 50. In this position the ram third portions 28 substantially block movement of material from within the auxiliary precompacting chambers 27 to the main compacting and storage chamber 15. In the position shown in FIG. 2, the doors 38 are held open by the position of ram second portions 26 contacting the door actuating arms 42. Material, such as bottles, plastic bottles and cans, is put into the auxiliary precompacting chambers 27 within liners 30.

Figure 3:
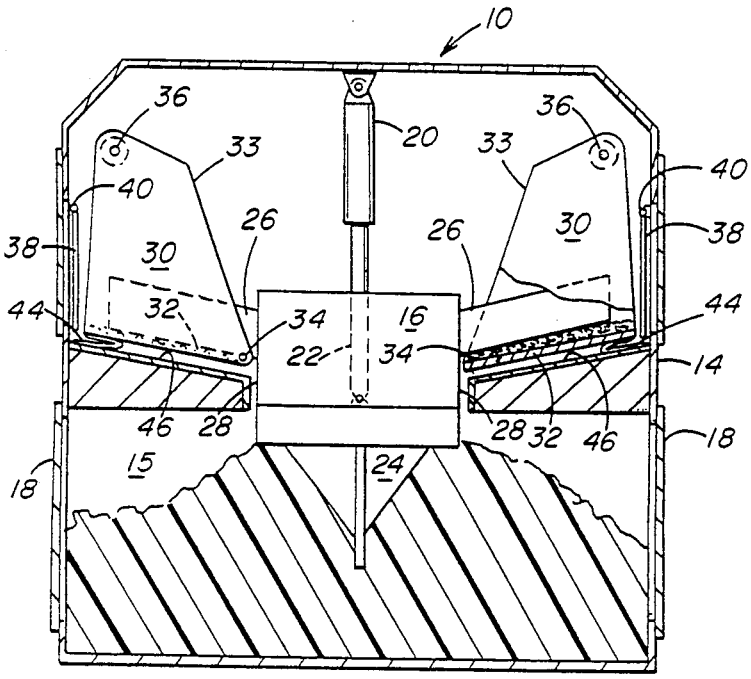
FIG. 3 is an elevation similar to FIG. 2 showing the ram of the compactor in a different position.
Figure 4:
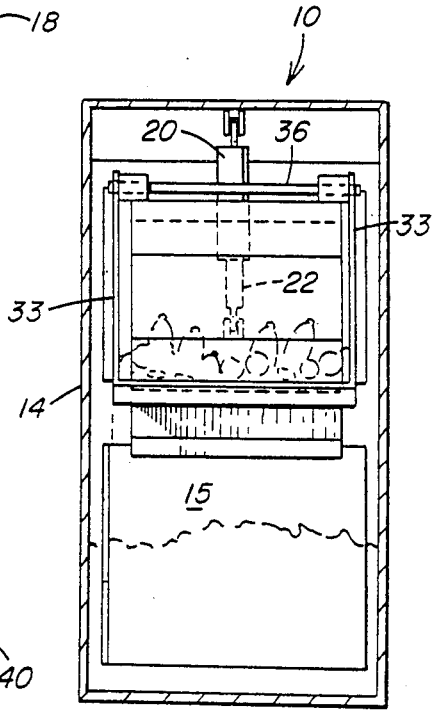
FIG. 4 is an end elevation in partial section taken along line 4—4 of FIG. 2.

The ram 16 is then lowered under the force of the hydraulic cylinder 20 and piston 22 to the position shown in FIG. 3 at which time the material within the auxiliary precompacting chambers 27 is precompacted by the second portions 26 of ram 16. In the position shown in FIG. 3, the first portion 24 of ram 16 enters the main compacting and storage chamber 15 thereby compacting for a second time material within that chamber 15 when the main compacting and storage chamber 15 becomes sufficiently filled with precompacted material. It will be noted that the doors 38 are closed while the ram 16 is in the position shown in FIG. 3 which prevents accidental entry of an operator's hand into the precompacting chambers 27 during the compacting stroke of the ram 16.

Figure 5:
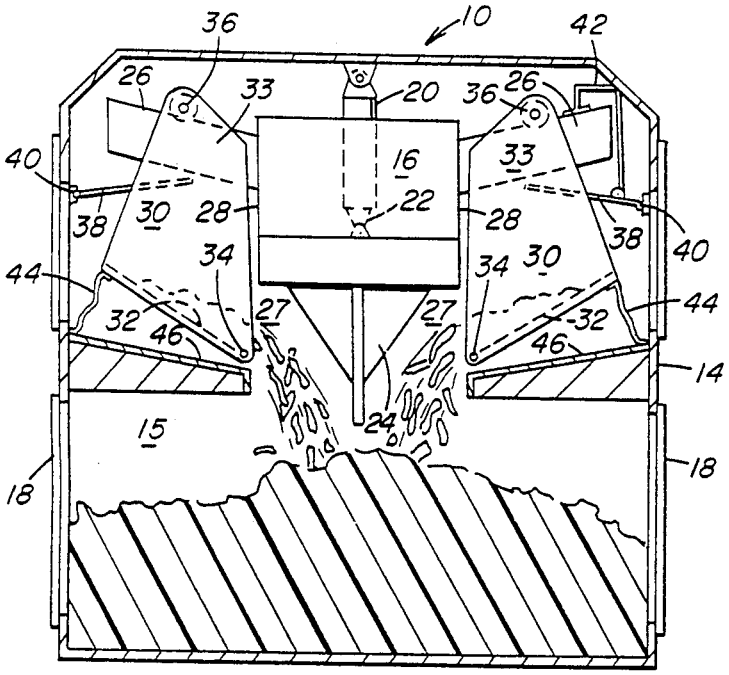
FIG. 5 is an elevation similar to FIGS. 2 and 3 showing the ram of the compactor in a third position.
Figure 6:
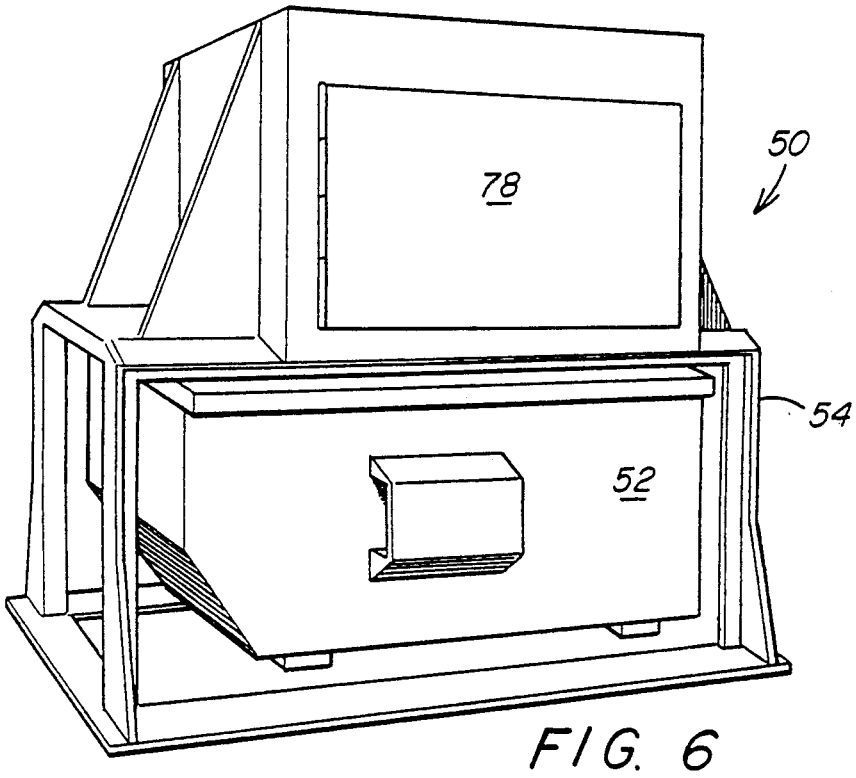
FIG. 6 is a perspective view of a second embodiment of the trash compactor of the present invention.

After the compacting stroke shown in FIG. 3, the ram 16 is retracted to the position shown in FIG. 5. In the FIG. 5 position, the ram 16 is withdrawn completely from the main compacting and storage chamber 15 and the ram second portions 26 contact the actuating bars 36 on liners 30 thereby pivoting liners 30 about pivot pins 34 to dump the material out of liners 30 and into the main compacting and storage chamber 15. The flexible webs 44 are extended in FIG. 5 to prevent any material from entering between the bottom wall 32 of each liner 30 and the bottom walls 46 of the respective auxiliary precompacting chambers 27. If material entered between the bottom walls of 32 of liners 30 and bottom walls 46 of precompacting chambers 27, it might prevent proper reseating of the liners 30 which is required for the compacting stroke shown in FIG. 3.

It will be seen that since the ram 16 is a unitary structure and moves vertically in a reciprocating motion that the precompacting of material within auxiliary precompacting chambers 27 occurs simultaneously with the compacting of material within the main compacting and storage chamber 15.

Referring now to FIGS. 6 through 10 there is shown a second embodiment of the present invention which is a trash compactor indicated generally at 50 for compacting trash within a removable receptacle 52. The receptacle 52 is designed to be situated in a stationary location, such as behind a commercial establishment, and to be hauled away by a specially equipped truck and replaced by an empty receptacle when full.

In the embodiment of FIGS. 7-10, the removable receptacle 52 is the main compacting and storage chamber of trash compactor 50. The auxiliary precompacting chamber 53 is a semi-permanent structure positioned above receptacle 52 upon a base 54 which receives the removable receptacle 52. The ram 56 is actuated by a hydraulic cylinder 60 and piston 62 to reciprocate vertically relative to the trash compactor base 54. The ram 56 has a first portion 64 which enters into receptacle 52 to contact material within the main compacting and storage chamber formed by receptacle 52. Ram 56 has a second portion 66 which compacts material within the auxiliary precompacting chamber 53 and a third portion 68 which substantially blocks movement of material from auxiliary precompacting chamber 53 into receptacle 52 when the ram 56 is in the position shown in FIG. 7.

As was described in connection with the embodiment of FIGS. 1-5, an auxiliary precompacting chamber 53 has a liner 70 with a bottom wall 72 and side walls 73 extending upwardly therefrom. The liner 70 is received on a horizontal pivot pin 74 within the precompacting chamber 53. The liner 70 also has a horizontal actuating bar 76 which is contacted by the ram second portion 66 to pivot the liner 70. A door 78 may be opened to place material into the precompacting chamber 53. The door 78 may be opened only when the ram is in the neutral position shown in FIG. 7 and must be in the closed position before the hydraulic cylinder 60 and piston 62 may be actuated to operate the ram 56. Accordingly, no web between the liner bottom wall 72 and the precompacting chamber bottom wall 80 is required since no material can enter into that space with the door 78 closed.

Figure 7:
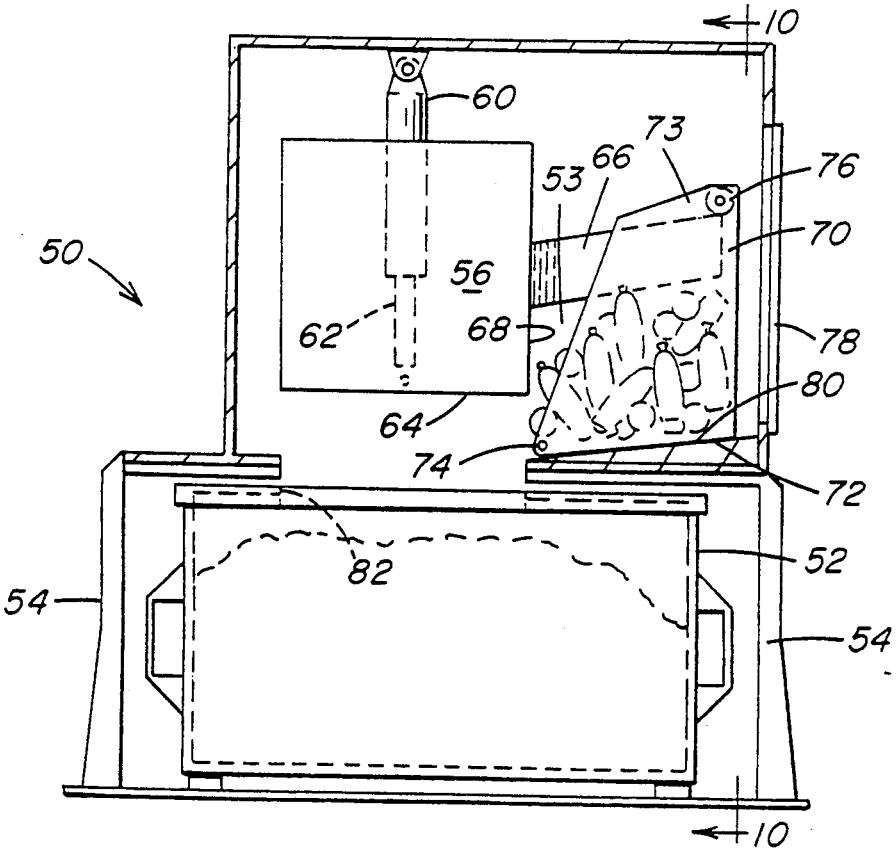
FIG. 7 is a front elevation in partial section of the compactor of FIG. 6.
Figure 8:
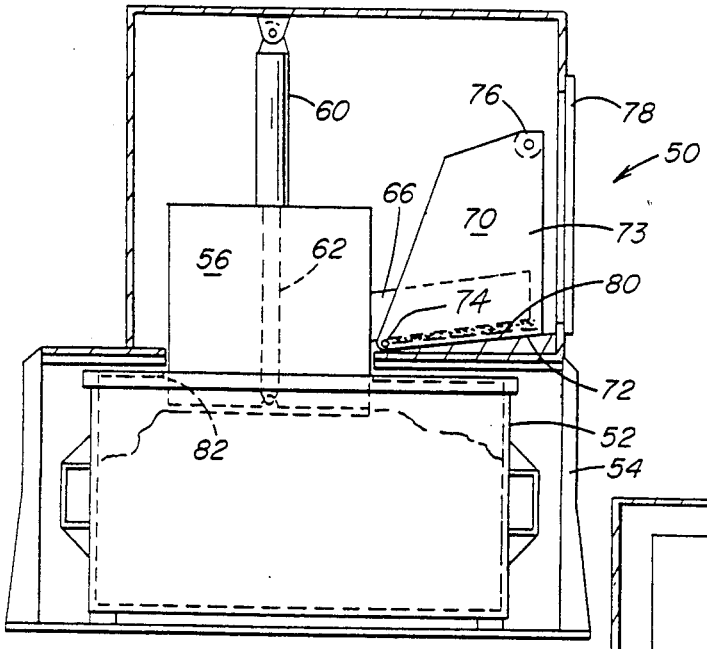
FIG. 8 is an elevation similar to FIG. 7 with the ram in a another position.
Figure 9:
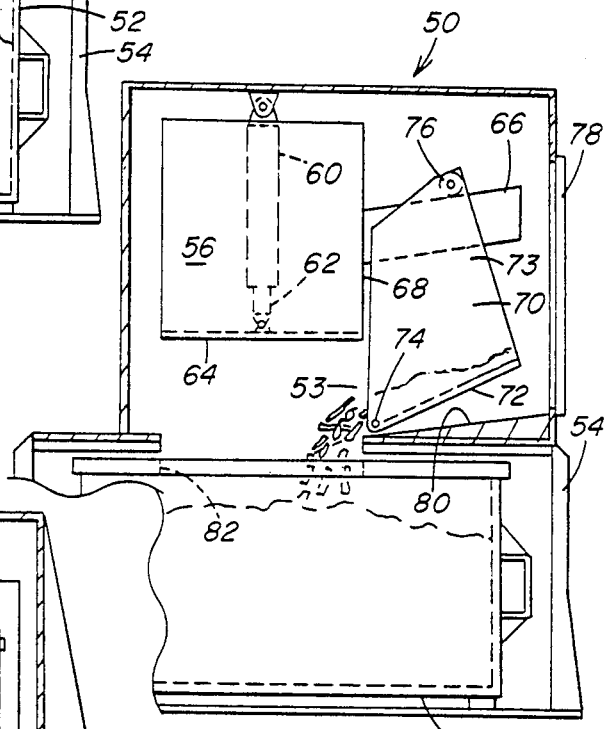
FIG. 9 is an elevation similar to FIGS. 7 and 8 with the ram in a third position.
Figure 10:
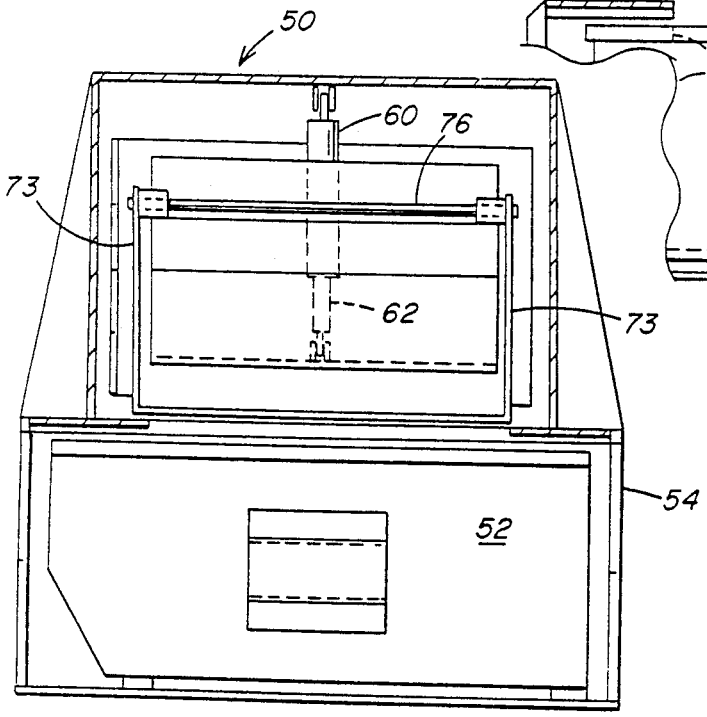
FIG. 10 is an end elevation in partial section taken along line 10—10 of FIG. 7.
Figure 11:
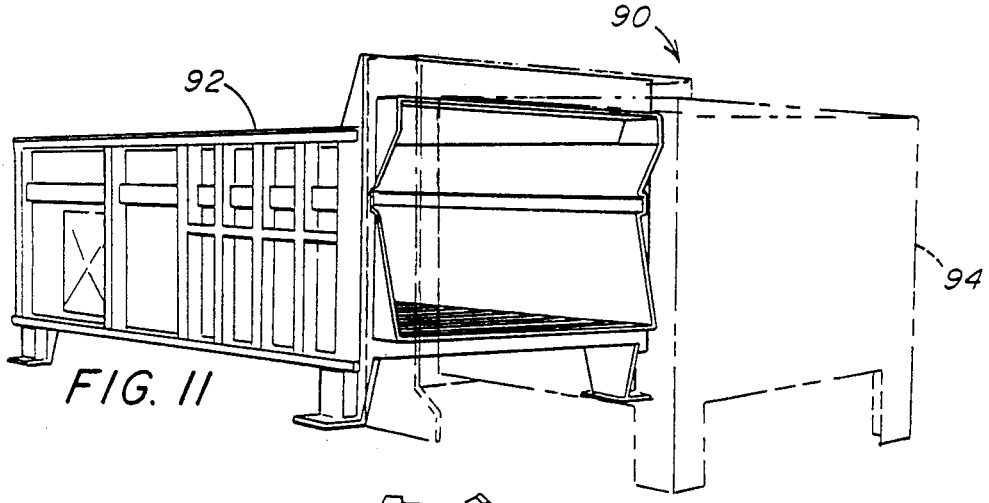
FIG. 11 is a perspective view of a third embodiment of the trash compactor of the present invention.

The embodiment of FIGS. 7-10 of the specification operates in a manner generally similar to that described in conjunction with the operation of the embodiment of FIGS. 1-5. As shown in FIG. 7, the ram 56 is in a neutral position and the door 78 may be opened to place trash within the liner 70 of precompacting chamber 53. After the trash is so positioned, door 78 is closed and the ram 56 is actuated. Ram 56 then moves vertically downwardly to the position shown in FIG. 8 where the second portion 66 of ram 56 precompacts the material within liner 70. At the same time, the first portion 64 of ram 56 enters into removable receptacle 52 which forms the main compacting and storage chamber through an opening 82 in the top wall of the receptacle 52. The ram first portion 64 thereby compacts material within receptacle 52 when receptacle 52 is sufficiently full of material that the ram performs the compacting action. After the compacting and precompacting stroke shown in FIG. 8, the ram is raised vertically to the position shown in FIG. 9 where the second portion 66 contacts the actuating bar 76 to pivot liner 70 above pivot 74 thereby dumping material from the liner 70 into the removable receptacle 52.

Referring now to FIGS. 11 through 14, there is shown a third embodiment of the present invention in which a large trash compactor 90 has a main compacting and storage chamber 92 with a compactor body 94 positioned at one end. A two part ram 95 is positioned within body 94. The first part 96 of ram 95 has a top wall 98, a bottom wall 100, side walls 102 and a rear wall 103 with a projection **103*a* extending upwardly therefrom and to each side for a purpose to be described. The second part 104 of two part ram 95 has a working face 106, a top wall 108, a bottom wall 110, and side walls 112. The two part ram is actuated by a hydraulic cylinder 120 fixed to the body 94 and a piston 122 fixed to the first part 96 of ram 95. A spring 124 surrounds the cylinder 120 and urges the rear wall 103 of the ram first part 96 away from the rear wall 114 of the ram second part 104. A door 126 is provided in the top of compactor body 94** to admit trash material to the compactor.

Figure 12:
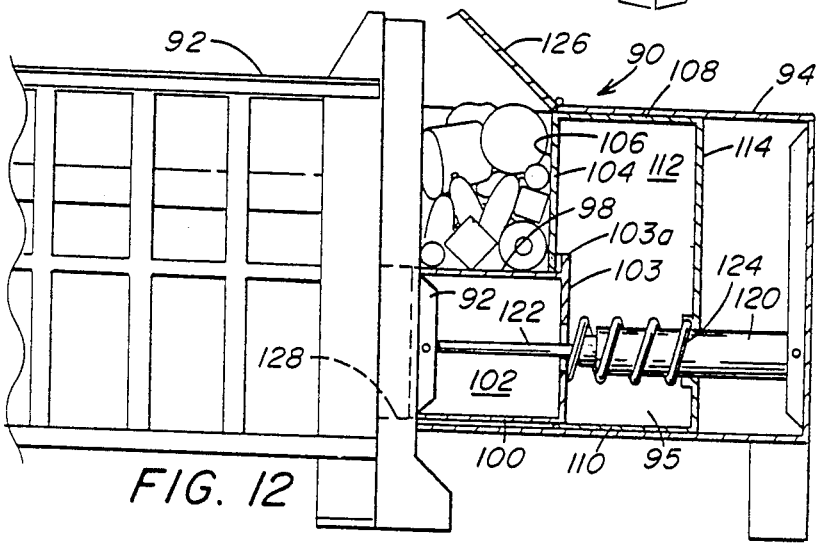
FIG. 12 is an elevation in partial section of the compactor of FIG. 11.

In operation, the ram 95 is initially in the neutral position shown in FIG. 12. At that time, the door 126 is opened and material and is introduced into the auxiliary precompacting chamber formed between the wall 127 of the main compacting and storage chamber 92 and the working face 106 of the second part 104 of ram 95. The precompacting chamber bottom wall is actually the top wall 98 of the ram first part 96. This top wall 98 of the ram first part 96 serves as the third portion of the ram 95 to prevent trash within the precompacting chamber from entering the main compacting and storage chamber 92 until the trash material is precompacted.

Figure 13:
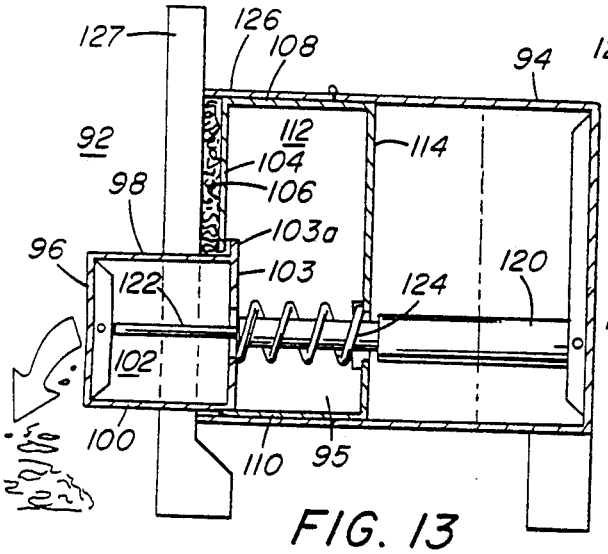
FIG. 13 is an elevation similar to FIG. 12 showing the ram in another position.

From the position shown in FIG. 12, the ram 95 is moved to the left as viewed in FIG. 13 so that the trash is precompacted between the wall 127 and the working face 106 of the ram second part 104. At the same time, the ram first portion 96 enters into the main compacting and storage chamber 92 through the opening 128 in wall 127 to further compact material within the main compacting and storage chamber 92.

Figure 14:
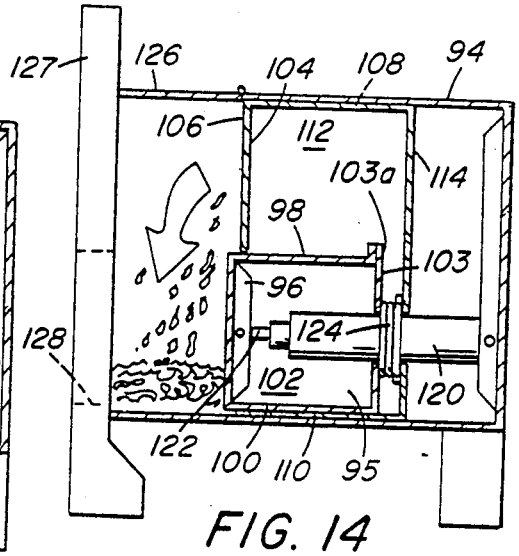
FIG. 14 is an elevation similar to FIGS. 11 and 12 showing the ram in still another position.

After the compacting stroke shown in FIG. 13, the ram 95 is retracted to the position shown in FIG. 14. In this position, the ram second part 104 is retracted to the position shown in FIG. 12 and the ram first part 96 is retracted into the ram second part so that the material that has been precompacted on the previous stroke now falls in front of ram first part 96 from where it is moved through opening 128 into the main compacting and storage chamber 92 when the ram is returned to the position shown in FIG. 12.

When the ram 95 is returned from the position shown in FIG. 14 to the position shown in FIG. 12, the spring 124 keeps the ram second part 104 back away from wall 127 of the main compacting and storage chamber 92 because it urges the ram second part rear wall 114 away from ram first part rear wall 103. Once the ram reaches the position shown in FIG. 12, the projection **103*a* on rear wall 103 of ram first part 96 contacts the working face 106 of ram second part 104 thereby causing the two parts of the ram to move in unison to the position shown in FIG. 13 upon further actuation of the cylinder 120 and piston 122**.

Figure 15:
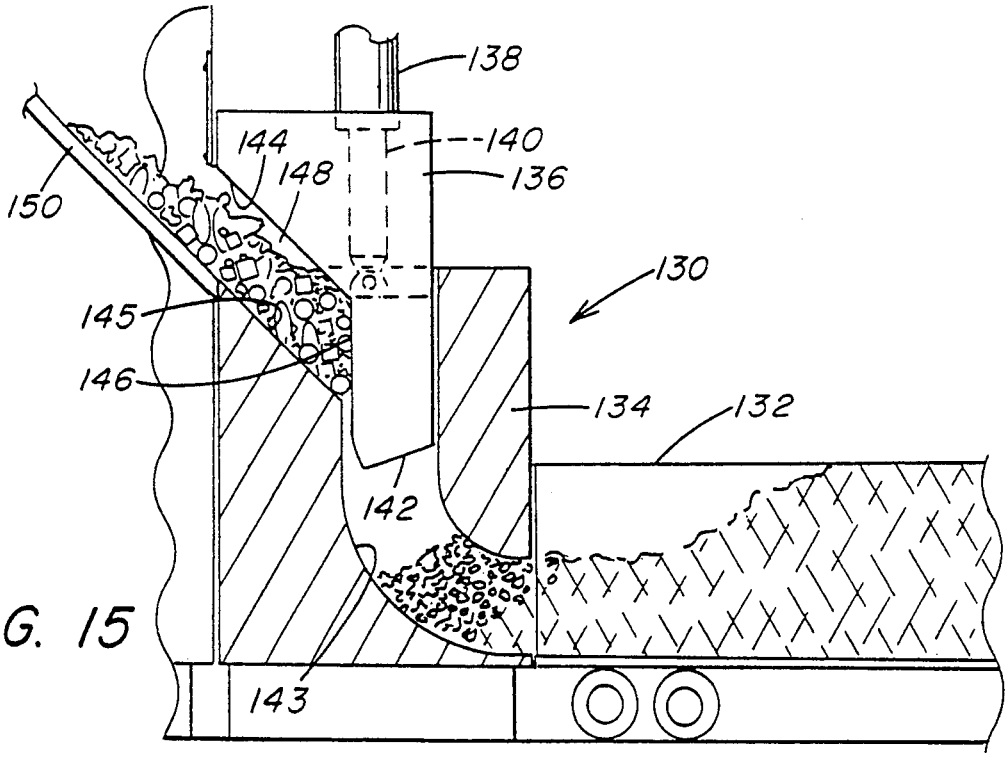
FIG. 15 is an elevation in partial section of a fourth embodiment of the trash compactor of the present invention.
Figure 16:
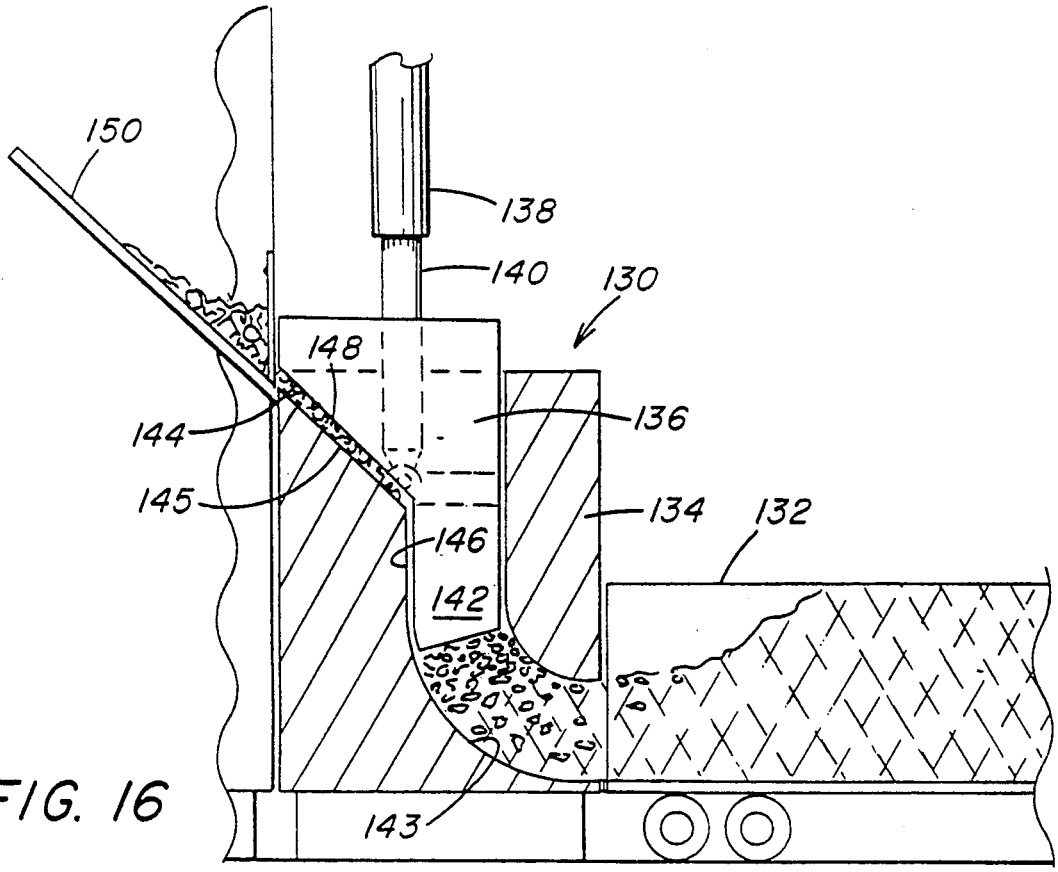
FIG. 16 is an elevation similar to FIG. 15 with the ram in another position.
Figure 17:
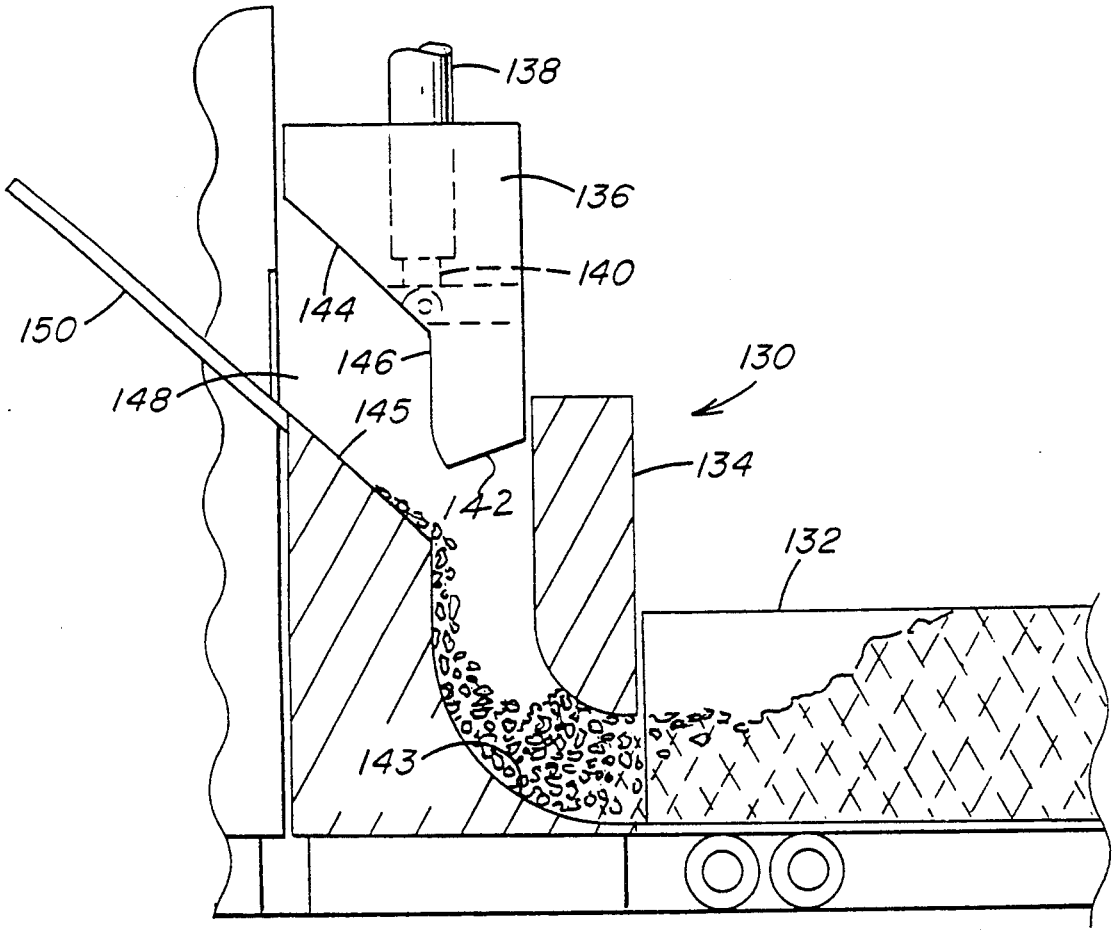
FIG. 17 is an elevation similar to FIGS. 15 and 16 with the ram in another position.

A fourth embodiment of the present invention is shown in FIGS. 15 through 17. In this embodiment, a trash compactor 130 is designed for permanent installation in a large building which serves as a transfer station for material collected by refuse trucks to be compacted and loaded into large trucks for long distance hauling.

In this embodiment, the main compacting and storage chamber is the long distance hauling vehicle 132. The vehicle 132 is parked adjacent to the body 134 of the trash compactor 130. A ram 136 is actuated by a hydraulic cylinder 138 fixed to the transfer station building (not shown) and a hydraulic piston 140. The cylinder 138 and piston 140 reciprocate the ram 136 in a vertical direction. The ram 136 has a first portion 142 which forces the compacted material through passage 143 into the vehicle 132. A second portion 144 of ram 136 precompacts material by moving into close proximity with the sloping wall 145 within compactor 130. A third portion 146 of ram 136 prevents material within the precompacting chamber 148 formed above sloping wall 145 from entering into the main compacting and storage area within the vehicle 132. The auxiliary precompacting chamber 148 is fed by a chute 150.

In operation, the ram 136 is positioned initially in the neutral position shown in FIG. 15. The trash material is then conveyed down chute 150 into auxiliary precompacting chamber 148 above the sloping wall 145. The ram 136 is then moved vertically downwardly by the cylinder 138 and piston 140 to the position shown in FIG. 16 where the material is precompacted within chamber 148 and the first portion 142 of ram 136 forces material through passage 143 and compacts it into the vehicle 132. It will be noted that because the vehicle 132 is immovably abutted against trash compactor body 134 the ram first portion 142 moves the material into vehicle 132 and compacts it within vehicle 132 as vehicle 132 becomes filled even though ram first portion 142 never enters into the main compacting and storage chamber within vehicle 132.

According to the provisions of the patent statutes, I have explained the principle, preferred construction and mode of operation of my invention and have illustrated and described that I now consider to represent its best embodiments. However, it should be understood that, within the scope of the appended claims, the invention may be practiced otherwise than as specifically illustrated and described.

I claim:

1. A trash compactor comprising:

a rigid main compacting and storage chamber;

an auxiliary precompacting chamber that is in unrestricted communication with said main compacting and storage chamber except when communication is blocked by a compacting ram;

a compacting ram having a first portion that compacts material within said main compacting and storage chamber, a second portion that compacts material within said auxiliary precompacting chamber and a third portion that blocks entry from said auxiliary precompacting chamber to said main compacting and storage chamber while said ram is compacting material in said auxiliary precompacting chamber;

means to reciprocate said ram relative to said main and auxiliary chambers to first compact material within said chambers when said ram is moving in a first direction and to thereafter permit unrestricted ingress of precompacted material from said auxiliary precompacting chamber to said main compacting and storage chamber after material is precompacted in said auxiliary precompacting chamber and said ram is retracted in a direction opposite to said first direction.

2. The trash compactor of claim 1 wherein said ram reciprocates vertically and said auxiliary precompacting chamber has a pivoting liner actuated by retraction of said ram to dump precompacted material from said auxiliary precompacting chamber into said main compacting and storage chamber.

3. The trash compactor of claim 2 wherein said auxiliary precompacting chamber is protected by a door that is closed when said ram is compacting material and is opened when said ram is retracted.

4. The trash compactor of claim 2 wherein said auxiliary precompacting chamber is protected by a door that must be in the closed position before said ram will move.

5. The trash compactor of claim 1 wherein said auxiliary precompacting chamber has a bottom wall that is sufficiently sloped that precompacted material moves by gravity into said main compacting and storage chamber when said ram is retracted.

6. The trash compactor of claim 5 wherein said ram compacts material within said main compacting and storage chamber without entering said main compacting and storage chamber.

7. The trash compactor of claim 1 wherein said ram reciprocates horizontally and said ram first portion moves forward to block ingress from said auxiliary precompacting chamber to said main compacting and storage chamber before said ram second portion moves forward to precompact material within said auxiliary precompacting chamber.

8. The trash compactor of claim 1 wherein said means to reciprocate said ram is a hydraulically actuated cylinder and piston fixed to the body of said trash compactor and to said ram.

9. The trash compactor of claim 1 having an additional auxiliary precompacting chamber that precompacts material for further compacting said storage in said main compacting and storage chamber.

10. The trash compactor of claim 1 wherein said main compacting and storage chamber is a replaceable, removable unit that may be removed when full and replaced by an empty unit.

11. A trash compactor comprising:

a main compacting and storage chamber having an opening on its upper side to receive trash;

an auxiliary precompacting chamber having a side opening to receive trash, said auxiliary precompacting chamber selectively communicating with said main compacting and storage chamber;

a unitary ram having a first portion that compacts material within said main compacting and storage chamber, a second portion that compacts material within said auxiliary precompacting chamber and a third portion that blocks entry from said auxiliary precompacting chamber to said main compacting and storage chamber while said ram is compacting material in said auxiliary precompacting chamber;

a hydraulic piston and cylinder to reciprocate said unitary ram vertically so that said ram moves downwardly to precompact and to compact trash within said auxiliary and main chambers respectively with said ram third portion blocking ingress from said auxiliary precompacting chamber to said main compacting and storage chamber and so that said ram moves upwardly to permit precompacted material to enter said main compacting and storage chamber;

said auxiliary precompacting chamber having a pivoting liner actuated by said ram, said liner having a bottom wall and two side walls pivotingly secured t the body of said trash compactor so that said bottom wall tilts upward when said ram moves upwardly to dump precompacted material from said auxiliary precompacting chamber into said main compacting and storage chamber.

12. The trash compactor of claim 11 having two auxiliary precompacting chambers that precompact material for further compacting and storage in said main compacting and storage chamber.

13. The trash compactor of claim 12 wherein each auxiliary precompacting chamber is protected by a door that is closed as said ram moves downwardly to compact material and is opened when said ram retracts upwardly.

14. The trash compactor of claim 11 wherein said auxiliary precompacting chamber is protected by a door that must be in the closed position before said ram will move.

15. The trash compactor of claim 11 wherein said pivoting liner has a flexible web connecting said liner bottom wall to the body of said trash compactor to prevent material from accidentally entering below said liner bottom wall when said liner is pivoted upwardly.

* * * * *

UNITED STATES PATENT AND TRADEMARK OFFICE

CERTIFICATE OF CORRECTION

PATENT NO. : 5,181,463

DATED : January 26, 1993

INVENTOR(S) : RAYMOND F. LACKNER

It is certified that error appears in the above-identified patent and that said Letters Patent is hereby corrected as shown below:

Column 3, line 67, change "50" to --30--.

Column 8, line 44, change "t" to --to--.

Signed and Sealed this

Thirtieth Day of November, 1993

*Attest:*

*Attesting Officer*

BRUCE LEHMAN

*Commissioner of Patents and Trademarks*